US008277579B2

(12) United States Patent
Makino

(10) Patent No.: US 8,277,579 B2
(45) Date of Patent: Oct. 2, 2012

(54) AMORPHOUS ALLOY COMPOSITION

(75) Inventor: Akihiro Makino, Sendai (JP)

(73) Assignee: Tohoku Techno Arch Co., Ltd., Sendai-shi, Miyagi (JP)

( * ) Notice: Subject to any disclaimer, the term of this patent is extended or adjusted under 35 U.S.C. 154(b) by 542 days.

(21) Appl. No.: 12/448,005

(22) PCT Filed: Dec. 4, 2007

(86) PCT No.: PCT/JP2007/001344

§ 371 (c)(1),
(2), (4) Date: Jul. 13, 2009

(87) PCT Pub. No.: WO2008/068899

PCT Pub. Date: Jun. 12, 2008

(65) Prior Publication Data

US 2010/0139814 A1 Jun. 10, 2010

(30) Foreign Application Priority Data

Dec. 4, 2006 (JP) ..... 2006-327623

(51) Int. Cl.
*H01F 1/153* (2006.01)
*C22C 45/02* (2006.01)

(52) U.S. Cl. ..... 148/304; 148/403; 420/87

(58) Field of Classification Search ..... None
See application file for complete search history.

(56) References Cited

U.S. PATENT DOCUMENTS

| | | | | |
|---|---|---|---|---|
| 4,473,401 | A * | 9/1984 | Masumoto et al. | 148/403 |
| 4,881,989 | A | 11/1989 | Yoshizawa et al. | |
| 5,160,379 | A | 11/1992 | Yoshizawa et al. | |
| 5,178,689 | A * | 1/1993 | Okamura et al. | 148/306 |
| 5,958,153 | A * | 9/1999 | Sakamoto et al. | 148/304 |
| 5,961,745 | A | 10/1999 | Inoue et al. | |
| 6,416,879 | B1 * | 7/2002 | Sakamoto et al. | 428/606 |
| 6,425,960 | B1 | 7/2002 | Yoshizawa et al. | |
| 2004/0140016 | A1 * | 7/2004 | Sakamoto et al. | 148/304 |
| 2009/0266448 | A1 | 10/2009 | Ohta et al. | |
| 2010/0043927 | A1 | 2/2010 | Makino | |
| 2010/0097171 | A1 | 4/2010 | Urata et al. | |

FOREIGN PATENT DOCUMENTS

| | | | |
|---|---|---|---|
| JP | 59/064740 | A * | 4/1984 |
| JP | 2573606 | A | 12/1988 |
| JP | 2812574 | A | 8/1992 |
| JP | 5-263197 | A | 10/1993 |
| JP | 7-11396 | A | 1/1995 |
| JP | 9-320827 | A | 12/1997 |

(Continued)

OTHER PUBLICATIONS

Shen, Baolong et al., "Formation, ductile deformation behavior and soft-magnetic properties of (Fe, Co, Ni)—B—Si—Nb bulk glass alloys," Intermetallics 15, (2007), pp. 9-16.

(Continued)

*Primary Examiner* — George Wyszomierski
(74) *Attorney, Agent, or Firm* — Holtz, Holtz, Goodman & Chick, P.C.

(57) ABSTRACT

An amorphous alloy has a specific composition of $Fe_aB_b$-$Si_cP_xCu_y$. Here, the values a-c, x, and y meet such conditions that 73 at %≦a≦85 at %, 9.65 at %≦b≦22 at %, 9.65 at %≦b+c≦24.75 at %, 0.25 at %≦x≦5 at %, 0 at %≦y≦0.35 at %, and 0≦y/x≦0.5.

19 Claims, 4 Drawing Sheets

FOREIGN PATENT DOCUMENTS

| | | | |
|---|---|---|---|
| JP | 11-071647 | A | 3/1999 |
| JP | 2004-2949 | A | 1/2004 |
| JP | 2004-349585 | A | 12/2004 |
| JP | 2005-60805 | A | 3/2005 |
| JP | 2005-290468 | A | 10/2005 |
| JP | 2006-40906 | A | 2/2006 |
| JP | 2007-107095 | A | 4/2007 |
| JP | 2007-270271 | A | 10/2007 |
| WO | WO 02/077300 | A1 | 10/2002 |
| WO | WO 2007/032531 | A1 | 3/2007 |
| WO | WO 2008/068899 | A1 | 6/2008 |
| WO | WO 2008/129803 | A1 | 10/2008 |

OTHER PUBLICATIONS

Y. Yoshizawa et al., "Fe Based Soft Magnetic Alloys Composed of Ultrafine Grain Structure," J. Japan Inst. Metals, vol. 53, No. 2 (Feb. 1989), pp. 241-248.

K. Yamauchi et al., "Iron Based Nanocrystalline Soft Magnetic Materials," Journal of Magnetics Society of Japan. vol. 14, No. 5, pp. 684-688, 1990.

K. Suzuki et al., "Low core losses of nanocrystalline Fe—M—B (M=Zr, Hf, or Nb) alloys," J. Appl. Phys. 74 (5), Sep. 1, 1993, 0021-8979/93/74(5), pp. 3316-3321.

H. Watanabe et al., "Soft Magnetic Properties and Structures of Nanocrystalline Fe—A1—Si—Nb—B Alloy Ribbons," Journal of Magnetics Society of Japan, vol. 17, No. 2, p. 191-196, (1993).

* cited by examiner

AMORPHOUS ALLOY COMPOSITION

TECHNICAL FIELD

The present invention relates to an amorphous alloy composition suitable for use in a transformer, an inductor, or the like, and more particularly to a Fe-based amorphous alloy composition having a soft magnetic property.

BACKGROUND ART

Heretofore, Fe—Si—B-based alloys have been used as Fe-based amorphous alloys for magnetic cores in transformers, sensors, and the like. However, because Fe—Si—B-based alloys have a low capability of forming an amorphous phase, they can only produce continuous ribbons having a thickness of about 20 μm to about 30 μm. Accordingly, Fe—Si—B-based alloys are only used for a wound magnetic core or a multilayered magnetic core produced by piling up those ribbons. Here, the "capability of forming an amorphous phase" is an index indicating a tendency for an alloy to transform into an amorphous phase in a cooling process after melting. Thus, when an alloy has a high capability of forming an amorphous phase, the alloy is not crystallized but is transformed into an amorphous phase without need for quick cooling.

Recently, there have been found alloys having a high capability of forming an amorphous phase, such as Fe—Co-based metallic glass alloys. However, those alloys have a considerably low saturation magnetic flux density.

DISCLOSURE OF INVENTION

Problem(s) to be Solved by the Invention

An object of the present invention is to provide an amorphous alloy composition which has a high saturation magnetic flux density and can provide an increase in thickness.

Means to Solve the Problem

The inventor has diligently studied a variety of alloy compositions to solve the aforementioned problems, has discovered that addition of P, Cu, or the like to an alloy including Fe—Si—B to limit its constituents can provide both of a high saturation magnetic flux density and a high capability of forming an amorphous phase, and has completed the present invention.

According to the present invention, there is provided an amorphous alloy composition of $Fe_aB_bSi_cP_xCu_y$ where 73 at %≦a≦85 at %, 9.65 at %≦b≦22 at %, 9.65 at %≦b+c≦24.75 at %, 0.25 at %≦x≦5 at %, 0 at %≦y≦0.35 at %, and 0≦y/x≦0.5.

Effect(s) of the Invention

According to the present invention, it is possible to readily produce a ribbon that is thicker than a conventional ribbon. Therefore, deterioration of properties due to crystallization can be reduced, and a yield can accordingly be improved.

Furthermore, according to the present invention, an occupancy ratio of a magnetic member is increased by reduction in the number of layers, the number of turns, or gaps between layers. Accordingly, an effective saturation magnetic flux density is increased. Additionally, an amorphous alloy composition according to the present invention has a high Fe content. The saturation magnetic flux density is increased in this point of view as well. When an amorphous alloy composition according to the present invention is used for a magnetic part included in a transformer, an inductor, a noise-related device, a motor, or the like, Then, miniaturization of those devices is expected from such an increased saturation magnetic flux density. Moreover, increase of the Fe content, which is inexpensive, can reduce material costs, which is very significant in an industrial aspect.

Furthermore, achievement of both of a high capability of forming an amorphous phase and a high saturation magnetic flux density allows a rod-like amorphous member, a plate-like amorphous member, a small-sized amorphous member having a complicated shape, and the like to be produced inexpensively as bulk materials, which have heretofore been impossible. Accordingly, a new market for amorphous bulk materials will be produced. Thus, a great contribution to an industrial development is expected.

DESCRIPTION OF REFERENCE NUMERALS

Figure 1:
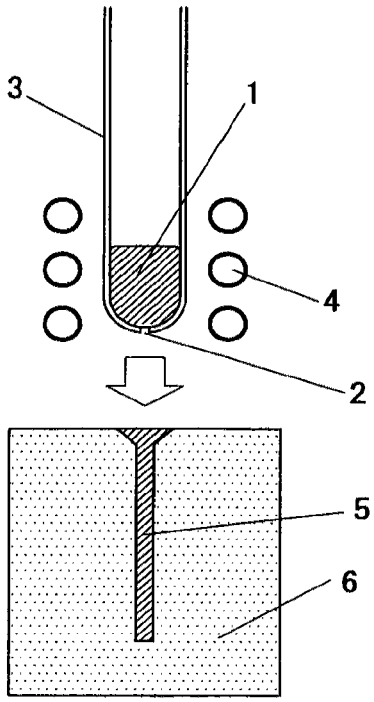
FIG. 1 is a side view schematically showing an apparatus for producing a rod-like sample by a copper mold casting method.

| | |
|---|---|
| 1 | Molten alloy |
| 2 | Small hole |
| 3 | Quartz nozzle |

-continued

| | |
|---|---|
| 4 | High-frequency coil |
| 5 | Rod-shaped mold |
| 6 | Copper mold |

BEST MODE FOR CARRYING OUT THE INVENTION

An amorphous alloy according to a preferred embodiment of the present invention has a specific composition of $Fe_aB_bSi_cP_xCu_y$ where 73 at %≦a≦85 at %, 9.65 at %≦b≦22 at %, 9.65 at %≦b+c≦24.75 at %, 0.25≦x≦5 at %, 0 at %≦y≦0.35 at %, and 0≦y/x≦0.5.

In the above specific composition, the Fe element is an essential element to provide magnetism. If the Fe element is less than 73 at %, the saturation magnetic flux density and the capability of forming an amorphous phase are low. Furthermore, reduction of the Fe content, which is inexpensive, causes an increase of other elements that are more expensive than Fe. Thus, the total material cost is increased, which is undesirable from industrial point of view. Accordingly, it is preferable to contain the Fe element at 73 at % or more. Meanwhile, if the Fe element is more than 85 at %, the amorphous phase becomes so unstable that the capability of forming an amorphous phase and the soft magnetic property are lowered. Accordingly, it is preferable to contain the Fe element at 85 at % or less.

In the above specific composition, the B element is an essential element to form an amorphous phase. If the B element is less than 9.65 at % or is more than 22 at %, the capability of forming an amorphous phase is lowered. Accordingly, it is preferable to contain the B element in a range of from 9.65 at % to 22 at %.

In the above specific composition, the Si element is an element to form an amorphous phase. If the sum of the Si element and the B element is less than 9.65 at %, the capability of forming an amorphous phase is lowered because the alloy lacks sufficient elements for forming an amorphous phase. Meanwhile, if the sum of the Si element and the B element is more than 24.75 at %, the capability of forming an amorphous phase is lowered because the alloy excessively contains elements for forming an amorphous phase. Furthermore, since the Fe content is relatively reduced, the saturation magnetic flux density is lowered. Accordingly, the sum of the Si element and the B element is preferably in a range of from 9.65 at % to 24.75 at %. Moreover, it is preferable to contain the Si element at 0.35 at % or more in view of embrittlement. In other words, it is preferable to meet the condition of 0.35 at %≦c in the above specific composition.

In the above specific composition, the P element is an element to form an amorphous phase. If the P element is less than 0.25 at %, a sufficient capability of forming an amorphous phase cannot be obtained. If the P element is more than 5 at %, embrittlement is induced, and the Curie point, the thermal stability, the capability of forming an amorphous phase, and the soft magnetic properties are lowered. Accordingly, it is preferable to contain the P element in a range of from 0.25 at % to 5 at %.

In the above specific composition, the Cu element is an element to form an amorphous phase. If the Cu element is more than 0.35 at %, embrittlement is induced, and the thermal stability and the capability of forming an amorphous phase are lowered. Accordingly, it is preferable to contain the Cu element at 0.35 at % or less.

Additionally, the Cu element should be added together with the P element. If a ratio of the Cu element and the P element, i.e., the Cu content/the P content (y/x), is more than 0.5, the Cu content is excessive to the P content so that the capability of forming an amorphous phase and the soft magnetic properties are lowered. Accordingly, the Cu content/the P content (y/x) is preferably 0.5 or less.

If the saturation magnetic flux density is required to be at least 1.30 T and the capability of forming an amorphous phase is required to form a thick ribbon, a rod-like member, a plate-like member, or a member having a complicated shape, Then, it is preferable to use the following ranges in the above specific composition: the Fe element: 73 at % to 79 at %; the B element: 9.65 at % to 16 at %; the sum of the B element and the Si element: 16 at % to 23 at %; the P element: 1 at % to 5 at %; and the Cu element: 0 at % to 0.35 at %. Particularly, it is more preferable to contain the Fe element in a range of from 75 at % to 79 at % because it is possible to obtain a good capability of forming an amorphous phase and a saturation magnetic flux density of at least 1.5 T.

Meanwhile, if the capability of forming an amorphous phase is required to facilitate production of a ribbon and a high saturation magnetic flux density of at least 1.55 T is required, Then, it is preferable to adopt a high Fe composition region: the Fe element: 79 at % to 85 at %; the B element: 9.65 at % to 15 at %; the sum of the B element and the Si element: 12 at % to 20 at %; the P element: 0.25 at % to 4 at %; and the Cu element: 0.01 at % to 0.35 at %.

In the above specific composition, a portion of the B element may be replaced with the C element. However, if the amount of replacement of the B element with the C element exceeds 2 at %, Then, the capability of forming an amorphous phase is lowered. Accordingly, the amount of replacement of the B element with the C element is preferably 2 at % or less.

Furthermore, in the above specific composition, a portion of Fe may be replaced with at least one element selected from the group consisting of Co and Ni. Replacement of the Fe element with the Co and/or Ni element is advantageous in that the soft magnetic properties can be improved by reduction of magnetostriction without a lowered capability of forming an amorphous phase. However, if the amount of replacement of the Fe element with the Co and/or Ni element exceeds 30 at %, Then, the saturation magnetic flux density is considerably lowered below 1.30 T, which is a practically important value. Accordingly, the amount of replacement of the Fe element with the Co and/or Ni element is preferably 30 at % or less.

Furthermore, in the above specific composition, a portion of Fe may be replaced with at least one element selected from the group consisting of V, Ti, Mn, Sn, Zn, Y, Zr, Hf, Nb, Ta, Mo, W, and rare-earth elements. The rare-earth elements include La, Ce, Pr, Nd, Pm, Sm, Eu, Gd, Tb, Dy, Ho, Er Tm, Yb, and Lu. Replacement of a portion of Fe with a metal such as V, Ti, Mn, Sn, Zn, Y, Zr, Hf, Nb, Ta, Mo, W, or rare-earth elements is advantageous in that the capability of forming an amorphous phase can be improved. However, excessive replacement, such as replacement of Fe that exceeds 3 at %, causes reduction of the Fe content and dilution of a magnetic moment in the amorphous alloy due to free electrons of metallic elements other than magnetic elements, so that the saturation magnetic flux density is considerably lowered. Accordingly, the amount of replacement of Fe with the metallic element is preferably 3 at % or less. The present invention does not negate addition of other metallic components for the purpose of improving practically required properties, such as corrosion resistance or thermal stability. Similarly, the present invention does not negate addition of unavoidable impurities coming from raw materials, a crucible, and the like.

When an amorphous alloy has the above composition, the capability of forming an amorphous phase is enhanced such that the amorphous alloy can have a variety of shapes and sizes, which have heretofore been difficult. For example, within the range of the above composition, it is possible to produce an ribbon-shaped amorphous alloy composition having a thickness in a range of from 30 μm to 300 μm, a plate-like amorphous alloy composition having a thickness of at least 0.5 mm, a rod-like amorphous alloy composition having an outside diameter of at least 1 mm, or an amorphous alloy composition having a predetermined shape including a plate-like portion or a rod-like portion having a thickness of at least 1 mm.

As described above, an amorphous alloy having soft magnetic properties according to an embodiment of the present invention has features in adjustment of composition in the alloy and in use of the alloy for a ribbon, a rod-like member, a plate-like member, or a member having a complicated shape. A conventional apparatus can be employed to produce such an amorphous alloy having soft magnetic properties.

For example, high-frequency induction heat melting, arc melting, or the like can be used for melting an alloy. It is preferable to carry out melting in an inert gas atmosphere in order to eliminate influence of oxidation. Nevertheless, sufficient melting can be carried out merely by flowing an inert gas or a reducing gas with high-frequency induction heating.

Methods of producing a ribbon or a plate-like member include a single-roll liquid quenching method, a twin-roll liquid quenching method, and the like. The thickness of a ribbon or a plate-like member can be adjusted by controlling a rotational speed of the rolls, the amount of liquid supplied, a gap between the rolls, and the like. Furthermore, the width of a ribbon can be adjusted by adjusting the shape of a liquid spout in a quartz nozzle or the like. Meanwhile, methods of producing a rod-like member, a small-sized member having a complicated shape, or the like include a copper mold casting method, an injection molding method, and the like. By adjusting the shape of a mold, it is possible to produce members having various shapes with high strength and excellent soft magnetic properties, which are characteristic of an amorphous alloy. However, the present invention is not limited to those methods. The amorphous alloy may be produced by other production methods. FIG. 1 is a schematic side view showing a configuration of a copper mold casting apparatus used to produce a rod-like part or a small-sized part having a complicated shape. A master alloy 1 having a predetermined composition is put into a quartz nozzle 3 having a small hole 2 at its end. The quartz nozzle 3 is placed right above a copper mold 6 having a hole 5 as a pouring space, which has a diameter of 1 mm to 4 mm and a length of 15 mm. Heat melting is carried out by a high-frequency generator coil 4, and Then, the molten metal 1 in the quartz nozzle 3 is spouted from the small hole 2 in the quartz nozzle 3 by a pressurized argon gas and poured into the hole of the copper mold 6. The metal is left in that state and solidified. Thus, a rod-like sample is produced.

The aforementioned ribbon may be used as a magnetic part, for example, in the form of a wound magnetic core or a multilayered magnetic core. Additionally, the aforementioned specific composition covers compositions having a supercooled liquid region. Formation using viscous flow can be performed on a sample at a temperature near the supercooled liquid region that does not exceed the crystallization temperature, which will be described later.

Figure 2:
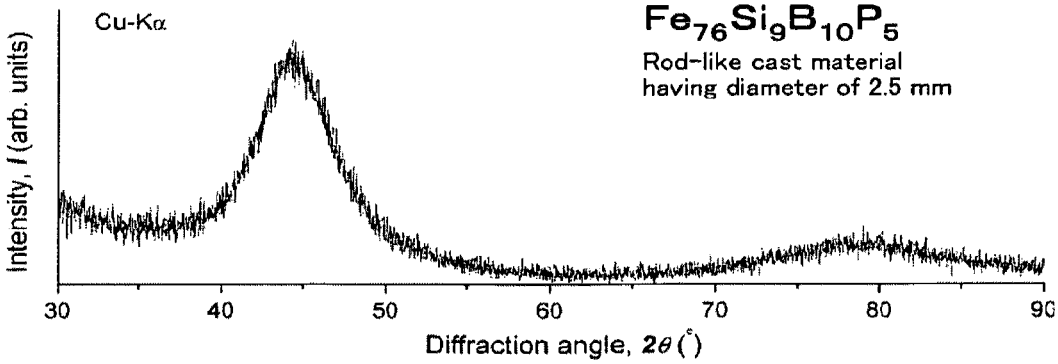
FIG. 2 is a graph showing X-ray diffraction results of a cross-section of a sample of an amorphous alloy composition according to an example of the present invention, wherein the sample of the amorphous alloy composition was a rod-like sample of $Fe_{76}Si_9B_{10}P_5$ produced by a copper mold casting method and had a diameter of 2.5 mm.
Figure 3:
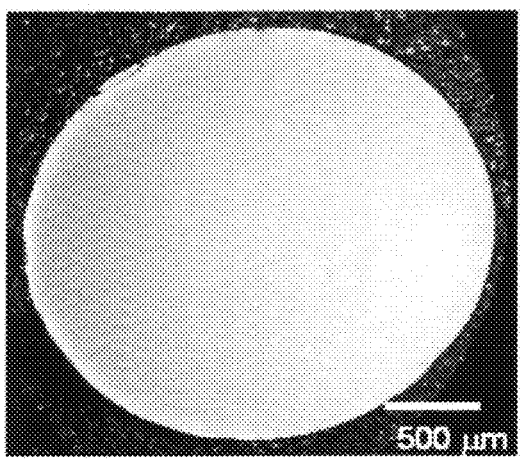
FIG. 3 is a copy of an optical microscope photograph showing a cross-section of the sample in FIG. 2.
Figure 4:
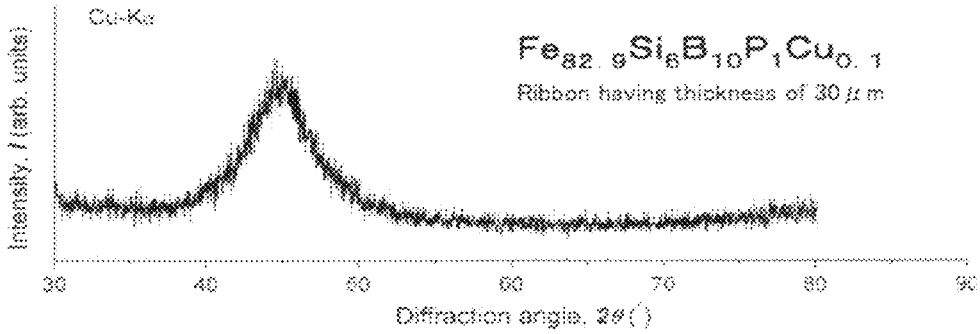
FIG. 4 is a graph showing X-ray diffraction results of a surface of a sample of an amorphous alloy composition according to another example of the present invention, wherein the sample of the amorphous alloy composition was a ribbon of $Fe_{82.9}Si_6B_{10}P_1Cu_{0.1}$ produced by a single-roll liquid quenching method so and had a thickness of 30 μm.

According to the present invention, an amorphous alloy composition is analyzed in crystal structure with an X-ray diffraction method. When the result demonstrates no sharp peak resulting from crystals and exhibits a halo pattern, the amorphous alloy composition is defined as having an "amorphous phase." When the result demonstrates a sharp crystal peak, the amorphous alloy composition is defined as having a "crystal phase." In this manner, the capability of forming an amorphous phase is evaluated. An amorphous alloy is an alloy that has been solidified with random atomic arrangements without crystallization at the time of cooling after pouring liquid, and requires a cooling rate above a certain value that conforms to the alloy composition. Furthermore, as an alloy composition is thicker, a cooling rate is lowered because of influence of heat capacity and heat conduction. Therefore, the thickness or the diameter of an alloy composition can also be used for evaluation. Here, the latter evaluation method is employed. Specifically, the capability of forming an amorphous phase is evaluated while the maximum thickness of a ribbon in which an amorphous single phase can be obtained by a roll liquid quenching method is defined as a maximum thickness with which an amorphous phase can be obtained ($t_{max}$), and the maximum diameter of a rod-like member in which an amorphous single phase can be obtained by a copper mold casting method is defined as a maximum diameter with which an amorphous phase can be obtained ($d_{max}$). An amorphous alloy composition having a maximum diameter $d_{max}$ greater than 1 mm has an excellent capability of forming an amorphous phase such that a continuous ribbon of at least 30 μm can readily be produced even by a single-roll liquid quenching method. In the case where the sample has a rod-like shape, the cross-section of the sample is evaluated by an X-ray diffraction method. In the case where the sample has a ribbon shape, a surface that does not contact with copper rolls at the time of quenching at which a cooling rate becomes the lowest is evaluated by an X-ray diffraction method. FIG. 2 shows an X-ray diffraction profile of a cross-section of a sample of an amorphous alloy composition in an example of the present invention. Here, the sample of the amorphous alloy composition was a rod-like sample of $Fe_{76}Si_9B_{10}P_5$ produced by a copper mold casting method and had a diameter of 2.5 mm and a length of 15 mm. As shown in FIG. 2, the rod-like sample of $Fe_{76}Si_9B_{10}P_5$ did not demonstrate a sharp peak resulting from crystals and only exhibited a broad halo pattern. Thus, it can be seen that the sample had an amorphous single phase. FIG. 3 shows a cross-section of this rod-like sample viewed with an optical microscope. As shown in FIG. 3, it can be seen that a texture of an amorphous single phase had no crystal grains. FIG. 4 shows an X-ray diffraction profile of a surface of a sample of an amorphous alloy composition according to another example of the present invention. Here, the sample of the amorphous alloy composition was a ribbon of $Fe_{82.9}Si_6B_{10}P_1Cu_{0.1}$ produced by a single-roll liquid quenching method and had a thickness of 30 μm. As shown in FIG. 4, the ribbon sample of $Fe_{82.9}Si_6B_{10}P_1Cu_{0.1}$ did not demonstrate a sharp peak resulting from crystals and only exhibited a broad halo pattern. Thus, it can be seen that the sample had an amorphous single phase.

Figure 5:
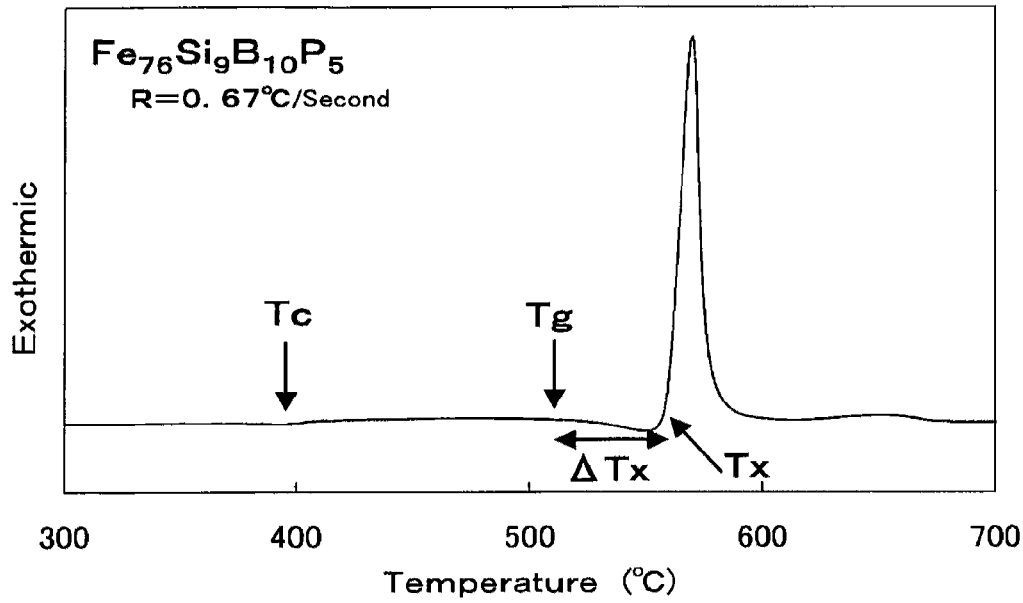
FIG. 5 is a graph showing a DSC curve of a sample of an amorphous alloy composition according to another example of the present invention when the sample was increased in temperature at 0.67° C./second, wherein the sample of the amorphous alloy composition was a ribbon of $Fe_{76}Si_9B_{10}P_5$ and had a thickness of 20 μm.

When an amorphous alloy composition having the aforementioned specific composition is increased in temperature within an inert atmosphere such as Ar, Then, an exothermic phenomenon resulting from crystallization of the composition generally occurs around 500° C. to 600° C. Furthermore, depending upon its composition, an endothermic phenomenon resulting from glass transition may occur at a temperature lower than a crystallization temperature. Here, a temperature at which a crystallization phenomenon starts is defined as a crystallization temperature (Tx), and a temperature at which glass transition starts is defined as a glass transition temperature (Tg). Furthermore, a temperature region between the crystallization temperature Tx and the glass transition temperature Tg is defined as a supercooled liquid region (ΔTx: ΔTx=Tx−Tg). The glass transition temperature and the crystallization temperature can be evaluated by thermal analysis having a temperature increase rate of 0.67° C./second with a differential scanning calorimetry apparatus (DSC). FIG. 5 shows a DSC measurement result of a case in which a sample of an amorphous alloy composition according to another example of the present invention was increased in temperature at 0.67° C./second. Here, the sample of the amorphous alloy composition was a ribbon of $Fe_{76}Si_9B_{10}P_5$ produced by a single-roll liquid quenching method and had a thickness of 20 μm. As shown in FIG. 5, in the case of the sample having a composition of $Fe_{76}Si_9B_{10}P_5$, an endothermic peak, which is called a supercooled liquid region, appeared at a temperature lower than an exothermic peak resulting from crystallization. A member of an amorphous single phase having the same composition demonstrates substantially the same DSC measurement results as described above, irrespective of its shape such as a ribbon or a rod-like member. As well known in the art, a supercooled liquid region relates to stabilization of an amorphous structure. The capability of forming an amorphous phase becomes higher as the supercooled liquid region is wider.

Figure 6:
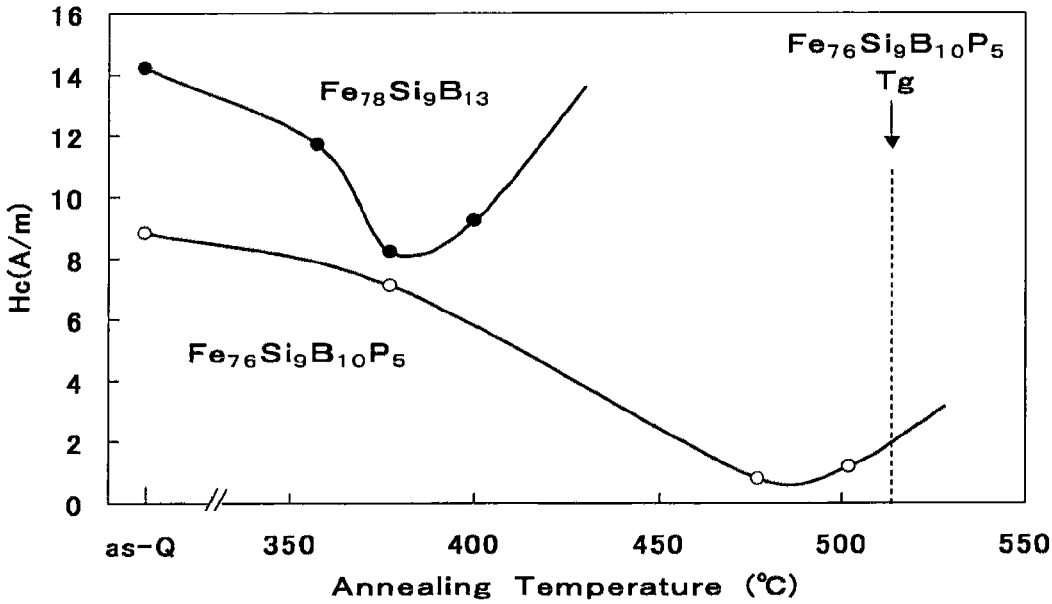
FIG. 6 is a graph showing heat treatment temperature dependencies of magnetic coercive forces with regard to a sample of an amorphous alloy composition according to another example of the present invention and a comparative sample in a conventional case, wherein the sample of the amorphous alloy composition of the present example was a ribbon of $Fe_{76}Si_9B_{10}P_5$ having a thickness of 20 μm, and the comparative sample was a ribbon of $Fe_{78}Si_9B_{13}$ having a thickness of 20 μm.

In an amorphous ribbon, rod-like member, or plate-like member of the present embodiment, heat treatment can reduce an internal stress applied during cooling or forming and can improve soft magnetic properties such as Hc and a magnetic permeability. The heat treatment can be performed within a temperature range that does not exceed the crystallization temperature Tx. Among amorphous alloy compositions having the aforementioned specific composition, an amorphous alloy having a supercooled liquid region can almost fully eliminate an internal stress by heat treatment performed around the glass transition temperature Tg for a short period of about 3 minutes to about 30 minutes and can thus obtain very excellent soft magnetic properties. Furthermore, heat treatment can be performed at a low temperature by lengthening a period of the heat treatment. The heat treatment in the present embodiment is performed in an inert gas such as $N_2$ or Ar or in a vacuum. However, the present invention is not limited to this example, and the heat treatment may be performed in other appropriate atmospheres. Additionally, the heat treatment can be performed in a static magnetic field, in a rotating magnetic field, or with a stress applied. FIG. 6 shows heat treatment temperature dependencies of the magnetic coercive force (Hc) with regard to a sample of an amorphous alloy composition in another example of the present invention and a comparative sample in a conventional case. Here, the sample of the amorphous alloy composition was a ribbon of $Fe_{76}Si_9B_{10}P_5$ produced by a single-roll liquid quenching method so as to have a thickness of 20 μm. The comparative sample was a ribbon of $Fe_{78}Si_9B_{13}$ produced by a single-roll liquid quenching method so as to have a thickness of 20 μm. The magnetic coercive force Hc was evaluated by a direct-current BH tracer. Furthermore, heat treatment was performed within an Ar atmosphere for each temperature on the $Fe_{76}Si_9B_{10}P_5$ composition for 5 minutes and on the $Fe_{78}Si_9B_{13}$ composition for 30 minutes. The heat treatment performed on the $Fe_{76}Si_9B_{10}P_5$ composition sample in the example greatly lessened the magnetic coercive force Hc, significantly at temperatures lower than the glass transition temperature Tg in particular. In contrast to the example, the comparative sample demonstrated magnetic coercive forces Hc of about 10 A/m even though it was subjected to the heat treatment.

An embodiment of the present invention will be described below in further detail with reference to several examples.

Examples 1-14 and Comparative Examples 1-5

Materials of Fe, Si, B, $Fe_{75}P_{25}$, and Cu were respectively weighed so as to provide alloy compositions of Examples 1-14 of the present invention and Comparative Examples 1-5 as listed in Table 1 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon becomes the lowest. An increase of the maximum thickness $t_{max}$ means that an amorphous structure can be obtained with a low cooling rate and that the amorphous structure has a high capability of forming an amorphous phase. Furthermore, for ribbons of a completely amorphous single phase having a thickness of 20 μm, the saturation magnetic flux density (Bs) was evaluated by a vibrating-sample magnetometer (VSM), and the magnetic coercive force Hc was evaluated by a direct-current BH tracer. The heat treatment was performed within an Ar atmosphere. Heat treatment was performed on the compositions having glass transition under conditions at a temperature 30° C. that was lower than the glass transition temperature Tg for a period of 5 minutes. Heat treatment was performed on the compositions having no glass transition under conditions at 400° C. for a period of 30 minutes. Table 1 shows the measurement results of the saturation magnetic flux density Bs, the magnetic coercive force Hc, the maximum thickness $t_{max}$, and the ribbon width of the amorphous alloys having compositions according to Examples 1-14 of the present invention and Comparative Examples 1-5.

TABLE 1

| | Alloy Composition (at %) | Bs (T) | Hc (A/m) | $t_{max}$ (μm) | Ribbon Width (mm) |
|---|---|---|---|---|---|
| Comparative Example 1 | $Fe_{70}Si_3B_{22}P_5$ | 1.28 | 12 | 30 | 3.1 |
| Comparative Example 2 | $Fe_{71}Si_{11}B_{13}P_5$ | 1.29 | 9.5 | 60 | 3.1 |
| Example 1 | $Fe_{73}Si_{10}B_{12}P_5$ | 1.42 | 2.4 | 100 | 2.7 |
| Example 2 | $Fe_{75}Si_4B_{16}P_5$ | 1.50 | 0.9 | 150 | 3.8 |
| Example 3 | $Fe_{76}Si_9B_{14}P_1$ | 1.53 | 1.8 | 60 | 3.3 |
| Example 4 | $Fe_{76}Si_9B_{12}P_3$ | 1.51 | 1.0 | 170 | 3.2 |
| Example 5 | $Fe_{76}Si_9B_{10}P_5$ | 1.51 | 0.8 | 240 | 3.2 |
| Example 6 | $Fe_{75.95}Si_9B_{10}P_5Cu_{0.05}$ | 1.51 | 0.9 | 250 | 3.4 |
| Example 7 | $Fe_{75.7}Si_9B_{10}P_5Cu_{0.3}$ | 1.50 | 3.1 | 200 | 3.0 |
| Example 8 | $Fe_{76.9}Si_9B_{10}P_4Cu_{0.1}$ | 1.53 | 0.8 | 230 | 3.2 |
| Example 9 | $Fe_{77.9}Si_8B_{10}P_4Cu_{0.1}$ | 1.56 | 1.2 | 180 | 3.0 |
| Example 10 | $Fe_{78}Si_7B_{10}P_5$ | 1.55 | 0.9 | 165 | 3.0 |
| Example 11 | $Fe_{78.9}Si_{6.35}B_{9.65}P_5Cu_{0.1}$ | 1.56 | 1.6 | 130 | 2.9 |
| Example 12 | $Fe_{73}Si_4B_{20}P_3$ | 1.44 | 3.0 | 65 | 2.9 |
| Example 13 | $Fe_{73}Si_2B_{22}P_3$ | 1.40 | 7.2 | 45 | 3.3 |
| Comparative Example 3 | $Fe_{73}Si_0B_{24}P_3$ | 1.41 | 14 | 20 | 3.1 |
| Example 14 | $Fe_{73}Si_5B_{19.75}P_2Cu_{0.25}$ | 1.40 | 6 | 65 | 2.9 |

TABLE 1-continued

| | Alloy Composition (at %) | Bs (T) | Hc (A/m) | $t_{max}$ (μm) | Ribbon Width (mm) |
|---|---|---|---|---|---|
| Comparative Example 4 | $Fe_{73}Si_1B_{24.75}P_1Cu_{0.25}$ | 1.43 | 12 | 25 | 3.2 |
| Comparative Example 5 | $Fe_{78}Si_9B_{13}$ | 1.55 | 9 | 37 | 3.1 |

As shown in Table 1, each of the amorphous alloy compositions of Examples 1-14 had a saturation magnetic flux density Bs of at least 1.30 T, had a higher capability of forming an amorphous phase as compared to Comparative Example 5, which is a conventional amorphous composition formed of Fe, Si, and B elements, and had a maximum thickness $t_{max}$ of at least 40 μm. Furthermore, the amorphous alloy compositions of Examples 1-14 exhibited a very small magnetic coercive force Hc, which was not greater than 9 A/m.

Among the compositions listed in Table 1, the compositions of Examples 1-11 and Comparative Examples 1 and 2 correspond to cases where the value a of the Fe content in $Fe_aB_bSi_cP_xCu_y$ is varied from 70 atomic % to 78.9 atomic %. The cases of Examples 1-11 met all conditions of Bs≧1.30 T, $t_{max}$≧40 μm, and Hc≦9 A/m. In these cases, a range of 73≦a defines a condition range for the parameter a in the present invention. Furthermore, the Fe content exerts large influence on the saturation magnetic flux density Bs as seen in Examples 2-11. In order to obtain a saturation magnetic flux density Bs of at least 1.50 T, it is preferable to set the Fe content to be at least 75 at %. In the cases of Comparative Examples 1 and 2 where a=70 and 71, respectively, the Fe content of a magnetic element was low, the saturation magnetic flux density Bs was lower than 1.30 T, and the magnetic coercive force Hc exceeded 9 A/m. Furthermore, in the case of Comparative Example 1, the capability of forming an amorphous phase was lowered, and the maximum thickness $t_{max}$ was less than 40 μm. Comparative Examples did not meet the aforementioned conditions from these points as well.

Among the compositions listed in Table 1, the compositions of Examples 3, 5, 12, and 13 and Comparative Example 3 correspond to cases where the value b of the B content in $Fe_aB_bSi_cP_xCu_y$ is varied from 10 atomic % to 24 atomic %. The cases of Examples 3, 5, 12, and 13 met all conditions of Bs≧1.30 T, $t_{max}$≧40 μm, and Hc≦9 A/m. In these cases, a range of b≦22 defines a condition range for the parameter b in the present invention. In the case of Comparative Example 3 where b=24, the capability of forming an amorphous phase was lowered, the maximum thickness $t_{max}$ was less than 40 μm, and the magnetic coercive force Hc exceeded 9 A/m.

Among the compositions listed in Table 1, the compositions of Examples 10-14 and Comparative Example 4 correspond to cases where the value b+c of the sum of the B content and the Si content in $Fe_aB_bSi_cP_xCu_y$ is varied from 16 atomic % to 27.75 atomic %. The cases of Examples 10-14 met all conditions of Bs≧1.30 T, $t_{max}$≧40 μm, and Hc≦9 A/m. In these cases, a range of b+c≦24.75 defines a condition range for the parameter b+c in the present invention. In the case of Comparative Example 4 where b+c=25.75, the capability of forming an amorphous phase was lowered, the maximum thickness $t_{max}$ was less than 40 μm, and the magnetic coercive force Hc exceeded 9 A/m.

Examples 15-42 and Comparative Examples 6-14

Materials of Fe, Si, B, $Fe_{75}P_{25}$, and Cu were respectively weighed so as to provide alloy compositions of Examples 15-42 of the present invention and Comparative Examples 6-14 as listed in Table 2 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed by a single-roll liquid quenching method so as to produce continuous ribbons having various thicknesses, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon becomes the lowest. Furthermore, a 30-μm ribbon was also formed for each sample and evaluated in the same manner as described above with an X-ray diffraction method to determine whether it had an amorphous phase or a crystal phase. Additionally, the saturation magnetic flux density Bs was measured for the produced ribbons. Measurement using VSM was not performed on samples that had a maximum thickness $t_{max}$ less than 20 μm and could not form a ribbon of an amorphous single phase because those samples did not reflect properties of an amorphous phase. Table 2 shows the measurement results of the saturation magnetic flux density Bs, the maximum thickness $t_{max}$, the ribbon width of the amorphous alloy ribbons having compositions according to Examples 15-42 of the present invention and Comparative Examples 6-14, and the X-ray diffraction of the 30-μm ribbons for those amorphous alloys.

TABLE 2

| | Alloy Composition (at %) | Bs (T) | $t_{max}$ (μm) | Ribbon Width (mm) | X-ray Diffraction Results of 30-μm-thickness ribbon |
|---|---|---|---|---|---|
| Example 15 | $Fe_{79}Si_8B_{12}P_{0.9}Cu_{0.1}$ | 1.58 | 105 | 3.1 | Amorphous Phase |
| Example 16 | $Fe_{80}Si_8B_{10}P_2$ | 1.60 | 80 | 3.3 | Amorphous Phase |
| Example 17 | $Fe_{80}Si_8B_{9.7}P_2Cu_{0.3}$ | 1.60 | 90 | 3.4 | Amorphous Phase |
| Example 18 | $Fe_{80}Si_7B_{12}P_{0.9}Cu_{0.1}$ | 1.61 | 90 | 3.3 | Amorphous Phase |
| Comparative Example 6 | $Fe_{81}Si_7B_{12}$ | 1.61 | 27 | 3.2 | Crystal Phase |
| Example 19 | $Fe_{81}Si_7B_{10}P_2$ | 1.62 | 60 | 3.3 | Amorphous Phase |
| Example 20 | $Fe_{80.9}Si_6B_{11}P_2Cu_{0.1}$ | 1.60 | 80 | 3.2 | Amorphous Phase |
| Comparative Example 7 | $Fe_{81}Si_{8.9}B_{10}Cu_{0.1}$ | — | <20 | 2.8 | Crystal Phase |
| Example 21 | $Fe_{82}Si_6B_{10}P_2$ | 1.62 | 35 | 3.2 | Amorphous Phase |
| Example 22 | $Fe_{81.99}Si_6B_{10}P_2Cu_{0.01}$ | 1.63 | 50 | 3.1 | Amorphous Phase |
| Example 23 | $Fe_{81.975}Si_6B_{10}P_2Cu_{0.025}$ | 1.63 | 60 | 2.7 | Amorphous Phase |
| Example 24 | $Fe_{81.9}Si_6B_{10}P_2Cu_{0.1}$ | 1.63 | 70 | 3.0 | Amorphous Phase |
| Example 25 | $Fe_{81.8}Si_6B_{10}P_2Cu_{0.2}$ | 1.62 | 70 | 2.8 | Amorphous Phase |

TABLE 2-continued

| | Alloy Composition (at %) | Bs (T) | $t_{max}$ (μm) | Ribbon Width (mm) | X-ray Diffraction Results of 30-μm-thickness ribbon |
|---|---|---|---|---|---|
| Example 26 | $Fe_{81.7}Si_6B_{10}P_2Cu_{0.3}$ | 1.63 | 65 | 3.1 | Amorphous Phase |
| Example 27 | $Fe_{81.65}Si_6B_{10}P_2Cu_{0.35}$ | 1.61 | 40 | 2.9 | Amorphous Phase |
| Comparative Example 8 | $Fe_{81.5}Si_6B_{10}P_2Cu_{0.5}$ | 1.63 | <20 | 2.8 | Crystal Phase |
| Example 28 | $Fe_{81.8}Si_7B_{10}P_1Cu_{0.2}$ | 1.62 | 60 | 3.1 | Amorphous Phase |
| Example 29 | $Fe_{81.8}Si_{7.6}B_{10}P_{0.4}Cu_{0.2}$ | 1.62 | 35 | 3.0 | Amorphous Phase |
| Comparative Example 9 | $Fe_{81.8}Si_{7.7}B_{10}P_{0.3}Cu_{0.2}$ | — | <20 | 2.8 | Crystal Phase |
| Comparative Example 10 | $Fe_{82}Si_8B_{10}$ | 1.62 | 20 | 3.3 | Crystal Phase |
| Comparative Example 11 | $Fe_{81.9}Si_8B_{10}Cu_{0.1}$ | — | <20 | 3.3 | Crystal Phase |
| Example 30 | $Fe_{81.9}Si_{7.75}B_{10}P_{0.25}Cu_{0.1}$ | 1.63 | 35 | 3.1 | Amorphous Phase |
| Example 31 | $Fe_{81.9}Si_7B_{10}P_1Cu_{0.1}$ | 1.62 | 60 | 3.2 | Amorphous Phase |
| Example 32 | $Fe_{81.9}Si_5B_{10}P_3Cu_{0.1}$ | 1.62 | 70 | 3.5 | Amorphous Phase |
| Example 33 | $Fe_{81.9}Si_4B_{10}P_4Cu_{0.1}$ | 1.63 | 55 | 3.3 | Amorphous Phase |
| Example 34 | $Fe_{81.9}Si_3B_{10}P_5Cu_{0.1}$ | 1.61 | 40 | 3.2 | Amorphous Phase |
| Comparative Example 12 | $Fe_{81.9}Si_1B_{10}P_7Cu_{0.1}$ | — | <20 | 3.2 | Amorphous Phase |
| Example 35 | $Fe_{82.9}Si_6B_{10}P_1Cu_{0.1}$ | 1.64 | 50 | 3.0 | Amorphous Phase |
| Example 36 | $Fe_{82.9}Si_2B_{10}P_5Cu_{0.1}$ | 1.62 | 45 | 3.3 | Amorphous Phase |
| Example 37 | $Fe_{83}Si_5B_{10}P_2$ | 1.64 | 30 | 3.5 | Amorphous Phase |
| Example 38 | $Fe_{83.9}Si_5B_{10}P_1Cu_{0.1}$ | 1.64 | 40 | 3.6 | Amorphous Phase |
| Example 39 | $Fe_{85}Si_{4.25}B_{9.65}P_1Cu_{0.1}$ | 1.65 | 30 | 3.4 | Amorphous Phase |
| Example 40 | $Fe_{84.9}Si_{2.35}B_{9.65}P_3Cu_{0.1}$ | 1.65 | 30 | 3.4 | Amorphous Phase |
| Example 41 | $Fe_{84.9}Si_{0.35}B_{9.65}P_5Cu_{0.1}$ | 1.64 | 30 | 3.1 | Amorphous Phase |
| Example 42 | $Fe_{85}B_{9.65}P_5Cu_{0.35}$ | 1.65 | 30 | 3.1 | Amorphous Phase |
| Comparative Example 13 | $Fe_{85.9}B_9P_5Cu_{0.1}$ | — | <20 | 3.2 | Crystal Phase |
| Comparative Example 14 | $Fe_{86}Si_3B_{10}P_{0.9}Cu_{0.1}$ | — | <20 | 3.2 | Crystal Phase |

As shown in Table 2, each of the amorphous alloy compositions of Examples 15-42 had a saturation magnetic flux density Bs of at least 1.55 T, i.e., that of Comparative Example 5, and also had a maximum thickness $t_{max}$ of at least 30 μm, of which ribbons can practically be mass-produced.

Among the compositions listed in Table 2, the compositions of Examples 15-42 and Comparative Examples 13 and 14 correspond to cases where the value a of the Fe content in $Fe_aB_bSi_cP_xCu_y$ is varied from 79 atomic % to 86 atomic %. The cases of Examples 15-42 met conditions of Bs≧1.55 T and $t_{max}$≧30 μm. Therefore, a range of a≦85 defines a condition range for the parameter a in the present invention. Considering the results of Examples 1-14 and Comparative Examples 1-5 in Table 1, the condition range for the parameter a of the present invention is a range of 73≦a≦85. In the cases of Comparative Examples 13 and 14 where the Fe element was 85.9 at % and 86 at %, respectively, the Fe content was so excessive that no amorphous phase was formed.

Among the compositions listed in Table 2, the compositions of Examples 38 and 39 and Comparative Example 13 correspond to cases where the value b of the B content in $Fe_aB_bSi_cP_xCu_y$ is varied from 9 atomic % to 10 atomic %. The cases of Examples 38 and 39 met conditions of Bs≧1.55 T and $t_{max}$≧30 μm as those alloys had the aforementioned specific composition. Therefore, a range of b≧9.65 in those cases defines a condition range for the parameter b of the present invention. Considering the results of Examples 1-14 and Comparative Examples 1-5 in Table 1, the condition range for the parameter b in the present invention is a range of 9.65≦b≦22. In the case of Comparative Example 13 where b=9, no amorphous phase was formed.

Among the compositions listed in Table 2, the compositions of Examples 15 and 38-42 and Comparative Example 13 correspond to cases where the value b+c of the sum of the B content and the Si content in $Fe_aB_bSi_cP_xCu_y$ is varied from 9 atomic % to 20 atomic %. The cases of Examples 15 and 38-42 met conditions of Bs≧1.55 T and $t_{max}$≧30 μm as those alloys had the aforementioned specific composition. Therefore, a range of b+c≧9.65 in those cases defines a condition range for the parameter b+c of the present invention. Considering the results of Examples 1-14 and Comparative Examples 1-5 in Table 1, the condition range for the parameter b+c of the present invention is a range of 9.65≦b+c≦24.75. In the case of Comparative Example 13 where b+c=9, no amorphous phase was formed.

Among the compositions listed in Table 2, the compositions of Examples 30-34 and Comparative Examples 10-12 correspond to cases where the value x of the P content in $Fe_aB_bSi_cP_xCu_y$ is varied from 0 atomic % to 7 atomic %. The cases of Examples 30-34 met conditions of Bs≧1.55 T and $t_{max}$≧30 μm as those alloys had the aforementioned specific composition. Therefore, a range of 0.25≦x≦5 in those cases defines a condition range for the parameter x of the present invention. In the case of Comparative Examples 10-12 where x=0 or 7, no amorphous phase was formed.

Among the compositions listed in Table 2, the compositions of Examples 21-27 and Comparative Example 8 correspond to cases where the value y of the Cu content in $Fe_aB_bSi_cP_xCu_y$ is varied from 0 atomic % to 0.5 atomic %. The cases of Examples 21-27 met conditions of Bs≧1.55 T and $t_{max}$≧30 μm as those alloys had the aforementioned specific composition. Therefore, a range of 0≦x≦0.35 in those cases defines a condition range for the parameter x in the present invention. Furthermore, as can be seen from Examples 22 and 23, even a trace of the Cu content is very effective in the capability of forming an amorphous phase. Thus, the Cu content is preferably at least 0.01 at %, more preferably at least 0.025 at %. In the case of Comparative Example 8 where y=0.5, no amorphous phase was formed.

Among the compositions listed in Table 2, the compositions of Examples 21, 28, and 29 and Comparative Example 9 correspond to cases where the value y/x, which is a ratio of Cu and P in $Fe_aB_bSi_cP_xCu_y$, is varied from 0 to 0.67. The cases of Examples 21, 28, and 29 met conditions of Bs≧1.55 T and $t_{max}$≧30 μm as those alloys had the aforementioned specific composition. Therefore, a range of 0≦x≦0.5 in those cases defines a condition range for the parameter x in the present invention. In the case of Comparative Example 9 where y/x=0.67, no amorphous phase was formed.

Examples 43-49 and Comparative Examples 15 and 16

Materials of Fe, Si, B, $Fe_{75}P_{25}$, and Cu were respectively weighed so as to provide alloy compositions of Examples 43-49 of the present invention and Comparative Examples 15 and 16 as listed in Table 3 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed by a single-roll liquid quenching method so as to produce continuous ribbons having a thickness of about 30 μm, a width of about 3 mm, and a length of about 5 m. The maximum thickness $t_{max}$ was measured for each ribbon by evaluation with an X-ray diffraction method on a surface of the ribbon that did not contact with copper rolls at the time of quenching at which a cooling rate of the ribbon becomes the lowest. Furthermore, the saturation magnetic flux density Bs was measured for the produced ribbons. Table 3 shows the evaluation results of the X-ray diffraction, the saturation magnetic flux density Bs, the ribbon thickness, and the adhesion bendability of the amorphous alloy ribbons having compositions according to Examples 43-49 of the present invention and Comparative Examples 15 and 16.

TABLE 3

| | Alloy Composition (at %) | X-ray Diffraction Results of Ribbon Surface | Bs (T) | Ribbon Thickness (μm) | Adhesion Bendability |
|---|---|---|---|---|---|
| Example 43 | $Fe_{85}B_{9.65}P_5Cu_{0.35}$ | Amorphous Phase | 1.65 | 30 | Incapable |
| Example 44 | $Fe_{84.9}Si_{0.35}B_{9.65}P_5Cu_{0.1}$ | Amorphous Phase | 1.64 | 30 | Capable |
| Example 45 | $Fe_{84.9}Si_{2.35}B_{9.65}P_3Cu_{0.1}$ | Amorphous Phase | 1.65 | 30 | Capable |
| Example 46 | $Fe_{81.9}Si_6B_{10}P_2Cu_{0.1}$ | Amorphous Phase | 1.63 | 30 | Capable |
| Example 47 | $Fe_{79}Si_8B_{12}P_{0.9}Cu_{0.1}$ | Amorphous Phase | 1.58 | 30 | Capable |
| Example 48 | $Fe_{76}Si_9B_{10}P_{4.9}Cu_{0.1}$ | Amorphous Phase | 1.51 | 30 | Capable |
| Example 49 | $Fe_{73}Si_{12}B_{10}P_{4.9}Cu_{0.1}$ | Amorphous Phase | 1.40 | 30 | Capable |
| Comparative Example 15 | $Fe_{71}Si_{14}B_{10}P_{4.9}Cu_{0.1}$ | Amorphous Phase | 1.28 | 30 | Incapable |
| Comparative Example 16 | $Fe_{68}Si_{17}B_{10}P_{4.9}Cu_{0.1}$ | Amorphous Phase | 1.22 | 30 | Incapable |

As shown in Table 3, each of the amorphous alloy compositions of Examples 43-49 had a saturation magnetic flux density Bs of at least 1.30 T and also had a maximum thickness $t_{max}$ of at least 30 μm, of which ribbons can practically be mass-produced. Furthermore, each of Comparative Examples 15 and 16 had a maximum thickness $t_{max}$ of at least 30 μm but a saturation magnetic flux density Bs lower than 1.30. When the adhesion bendability was evaluated for Examples 43-49 and Comparative Examples 15 and 16, adhesion bending could not successfully be conducted for Example 43 and Comparative Examples 15 and 16, resulting in embrittlement. Therefore, it is preferable for the value b+c, which is the sum of the B content and the Si content, to be in a range of from 10 at % to 22 at %. Moreover, it is preferable to contain the Si element in a range of from 0.35 at % to 12 at %.

Examples 50-52 and Comparative Examples 17-20

Materials of Fe, Si, B, $Fe_{75}P_{25}$, Cu, Nb, Al, Ga, and $Fe_{80}C_{20}$ were respectively weighed so as to provide alloy compositions of Examples 50-52 of the present invention and Comparative Examples 17-20 as listed in Table 4 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were poured into a copper mold with a cylindrical hole having a diameter of 1 mm to 3 mm by a copper mold casting method so as to produce rod-like samples having various diameters and a length of about 15 mm. Cross-sections of those rod-like samples were evaluated by an X-ray diffraction method so as to measure the maximum diameter $d_{max}$ of those rod-like samples. Additionally, for rod-like samples having a fully amorphous single phase, the supercooled liquid region ΔTx was calculated from measurement of the glass transition temperature Tg and the crystallization temperature Tx by DSC, and the saturation magnetic flux density Bs was measured by VSM. For alloys that could not form a rod-like sample having an amorphous single phase of at least 1 mm, the saturation magnetic flux density Bs was measured on ribbons having a thickness of 20 μm. Table 4 shows the measurement results of the saturation magnetic flux density Bs, the supercooled liquid region ΔTax, and the maximum diameter $d_{max}$ of the amorphous alloys having compositions according to Examples 50-52 of the present invention and Comparative Examples 17-20.

TABLE 4

| | Alloy Composition (at %) | Bs (T) | ΔTx (° C.) | $d_{max}$ (mm) |
|---|---|---|---|---|
| Example 50 | $Fe_{75}Si_9B_{13}P_3$ | 1.46 | 39 | 1.5 |
| Example 51 | $Fe_{76}Si_9B_{10}P_5$ | 1.51 | 52 | 2.5 |
| Example 52 | $Fe_{75.9}Si_9B_{10}P_5Cu_{0.1}$ | 1.50 | 55 | 2.5 |
| Comparative Example 17 | $Fe_{78}Si_9B_{13}$ | 1.55 | — | ≦1 |
| Comparative Example 18 | $(Fe_{0.75}Si_{0.10}B_{0.15})_{96}Nb_4$ | 1.18 | 32 | 1.5 |
| Comparative Example 19 | $Fe_{73}Al_5Ga_2P_{11}C_5B_4$ | 1.29 | 53 | 1 |

TABLE 4-continued

| | Alloy Composition (at %) | Bs (T) | ΔTx (° C.) | $d_{max}$ (mm) |
|---|---|---|---|---|
| Comparative Example 20 | $Fe_{72}Al_5Ga_2P_{10}C_6B_4Si_1$ | 1.14 | 53 | 2 |

As shown in Table 4, each of the amorphous alloy compositions of Examples 50-52 had a saturation magnetic flux density Bs of at least 1.30 T, also had a clear supercooled liquid region ΔTx of at least 30° C., and had an outside diameter of at least 1 mm. In contrast thereto, Comparative Example 17 did not have a supercooled liquid region ΔTx, and its maximum diameter $d_{max}$ was smaller than 1 mm. Comparative Examples 18-20, which are typical metallic glass alloys that have been well known, had a supercooled liquid region ΔTx, and the diameter of rod-like samples that could form an amorphous single phase exceeded 1 mm. However, the Fe content was low, and the saturation magnetic flux density Bs was lower than 1.30.

Examples 53-62 and Comparative Examples 21-23

Materials of Fe, Co, Ni, Si, B, $Fe_{75}P_{25}$, Cu, and Nb were respectively weighed so as to provide alloy compositions of Examples 53-62 of the present invention and Comparative Examples 21-23 as listed in Table 5 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were poured into a copper mold with a cylindrical hole having a diameter of 1 mm and a length of 15 mm by a copper mold casting method so as to produce rod-like samples. Cross-sections of those rod-like samples were evaluated by an X-ray diffraction method so as to determine whether the samples had an amorphous single phase or a crystal phase. Furthermore, for rod-like samples having a fully amorphous single phase, the supercooled liquid region ΔTx was calculated from measurement of the glass transition temperature Tg and the crystallization temperature Tx by DSC, and the saturation magnetic flux density Bs was measured by VSM. Table 5 shows the measurement results of the saturation magnetic flux density Bs, the supercooled liquid region ΔTx of the amorphous alloys having compositions according to Examples 53-62 of the present invention and Comparative Examples 21-23, and the X-ray diffraction of cross-sections in rod-like samples having a diameter of 1 mm for those amorphous alloys.

TABLE 5

| | Alloy Composition (at %) | Bs (T) | ΔTx (° C.) | X-ray Diffraction Results of Cross-section of Rod Member |
|---|---|---|---|---|
| Example 53 | $Fe_{76}Si_9B_{10}P_5$ | 1.51 | 52 | Amorphous Phase |
| Example 54 | $Fe_{66}Co_{10}Si_9B_{10}P_5$ | 1.40 | 52 | Amorphous Phase |
| Example 55 | $Fe_{56}Co_{20}Si_9B_{10}P_5$ | 1.35 | 44 | Amorphous Phase |
| Example 56 | $Fe_{56}Co_{20}Si_9B_{10}P_{4.9}Cu_{0.1}$ | 1.34 | 44 | Amorphous Phase |
| Example 57 | $Fe_{46}Co_{30}Si_9B_{10}P_5$ | 1.31 | 37 | Amorphous Phase |
| Comparative Example 21 | $Fe_{36}Co_{40}Si_9B_{10}P_5$ | 1.28 | 43 | Amorphous Phase |
| Example 58 | $Fe_{46}Ni_{30}Si_9B_{10}P_5$ | 1.30 | 53 | Amorphous Phase |
| Comparative Example 22 | $Fe_{36}Ni_{40}Si_9B_{10}P_5$ | 1.18 | 39 | Amorphous Phase |
| Example 59 | $Fe_{56}Co_{10}Ni_{10}Si_9B_{10}P_5$ | 1.34 | 54 | Amorphous Phase |
| Example 60 | $Fe_{56}Co_{10}Ni_{10}Si_9B_{10}P_{4.9}Cu_{0.1}$ | 1.34 | 55 | Amorphous Phase |
| Example 61 | $Fe_{46}Co_{15}Ni_{15}Si_9B_{10}P_5$ | 1.30 | 42 | Amorphous Phase |
| Example 62 | $Fe_{46}Co_{20}Ni_{10}Si_9B_{10}P_5$ | 1.35 | 41 | Amorphous Phase |
| Comparative Example 23 | $Fe_{36}Co_{20}Ni_{20}Si_9B_{10}P_5$ | 1.21 | 36 | Amorphous Phase |

As shown in Table 5, each of the amorphous alloy compositions of Examples 53-62 had a saturation magnetic flux density Bs of at least 1.30 T, also had a clear supercooled liquid region ΔTx of at least 30° C., and had a maximum diameter $d_{max}$ of at least 1 mm.

Among the compositions listed in Table 5, the compositions of Examples 53-57 and Comparative Example 21 correspond to cases where the Fe element is replaced with the Co element in a range of from 0 at % to 40 at %. The cases of Examples 53-57 met conditions of Bs≧1.30 T and $d_{max}$≧1 mm as those alloys had the aforementioned specific composition. Furthermore, those compositions had a clear supercooled liquid region ΔTx. Comparative Example 21 containing the Co element at 40 at % had a clear supercooled liquid region ΔTx of at least 30° C. and a maximum diameter $d_{max}$ of at least 1 mm. However, the Co content was so excessive that the saturation magnetic flux density Bs was lower than 1.30 T.

Among the compositions listed in Table 5, the compositions of Examples 53 and 58 and Comparative Example 22 correspond to cases where the Fe element is replaced with the Ni element in a range of from 0 at % to 40 at %. The cases of Examples 53 and 58 met conditions of Bs≧1.30 T and $d_{max}$≧1 mm as those alloys had the aforementioned specific composition. Furthermore, those compositions had a clear supercooled liquid region ΔTx. Comparative Example 22 containing the Ni element at 40 at % had a clear supercooled liquid region ΔTx of at least 30° C. and a maximum diameter $d_{max}$ of at least 1 mm. However, the Ni content was so excessive that the saturation magnetic flux density Bs was lower than 1.30 T.

Among the compositions listed in Table 5, the compositions of Examples 59-62 and Comparative Example 23 correspond to cases where the Fe element is replaced jointly with the Co element and the Ni element in a range of from 0 at % to 40 at %. The cases of Examples 59-62 met conditions of Bs≧1.30 T and $d_{max}$≧1 mm as those alloys had the aforementioned specific composition. Furthermore, those compositions had a clear supercooled liquid region ΔTx. Comparative Example 23 containing the Co element and the Ni element at 40 at % in total had a clear supercooled liquid region ΔTx of at least 30° C. and a maximum diameter $d_{max}$ of at least 1 mm. However, the Ni content was so excessive that the saturation magnetic flux density Bs was lower than 1.30 T.

Amorphous alloy compositions in which Cu was added to each of the above examples were evaluated in detail. As a result, each amorphous alloy composition had a saturation magnetic flux density Bs of at least 1.30 T and a clear supercooled liquid region ΔTx of at least 30° C. as with Examples 56 and 58, and also had a maximum diameter $d_{max}$ of at least 1 mm.

Examples 63-66 and Comparative Example 24

Materials of Fe, Si, B, $Fe_{75}P_{25}$, Cu, Nb, and $Fe_{80}C_{20}$ were respectively weighed so as to provide alloy compositions of Examples 63-66 of the present invention and Comparative Example 24 as listed in Table 6 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were poured into a copper mold with a cylindrical hole having a diameter of 1 mm to 4 mm by a copper mold casting method so as to produce rod-like samples having various diameters and a length of about 15 mm. Cross-sections of those rod-like samples were evaluated by an X-ray diffraction method so as to determine whether the samples had an amorphous single phase or a crystal phase. Additionally, for rod-like samples having a fully amorphous single phase, the supercooled liquid region ΔTx was calculated from measurement of the glass transition temperature Tg and the crystallization temperature Tx by DSC, and the saturation magnetic flux density Bs was measured by VSM. For alloys that could not form a rod-like sample having an amorphous single phase of at least 1 mm, the saturation magnetic flux density Bs was measured on ribbons having a thickness of 20 μm. Table 6 shows the measurement results of the saturation magnetic flux density Bs, the supercooled liquid region ΔTx, and the maximum diameter $d_{max}$ of the amorphous alloys having compositions according to Examples 63-66 of the present invention and Comparative Example 24.

TABLE 6

| | Alloy Composition (at %) | Bs (T) | ΔTx (° C.) | $d_{max}$ (mm) |
|---|---|---|---|---|
| Example 63 | $Fe_{76}Si_9B_{10}P_5$ | 1.51 | 52 | 2.5 |
| Example 64 | $Fe_{76}Si_9B_9P_5C_1$ | 1.50 | 46 | 2 |
| Example 65 | $Fe_{76}Si_9B_8P_{4.9}C_2Cu_{0.1}$ | 1.51 | 48 | 2 |
| Example 66 | $Fe_{76}Si_9B_8P_5C_2$ | 1.50 | 49 | 1.5 |
| Comparative Example 24 | $Fe_{76}Si_9B_6P_5C_4$ | 1.43 | ≦30 | ≦1 |

As shown in Table 6, each of the amorphous alloy compositions of Examples 63-66 had a saturation magnetic flux density Bs of at least 1.30 T, also had a clear supercooled liquid region ΔTx of at least 30° C., and had a maximum diameter $d_{max}$ of at least 1 mm.

Among the compositions listed in Table 6, the compositions of Examples 63-66 and Comparative Example 24 correspond to cases where the C element is varied from 0 at % to 4 at %. The cases of Examples 63-66 met conditions of Bs≧1.30 T and $d_{max}$≧1 mm as those alloys had the aforementioned specific composition. Furthermore, those compositions had a clear supercooled liquid region ΔTx. Comparative Example 24 containing the C element at 4 at % had a narrowed supercooled liquid region ΔTx and a maximum diameter $d_{max}$ smaller than 1 mm.

Examples 67-98 and Comparative Example 25

Materials of Fe, Co, Si, B, $Fe_{75}P_{25}$, Cu, Nb, $Fe_{80}C_{20}$, V, Ti, Mn, Sn, Zn, Y, Zr, Hf, Nb, Ta, Mo, W, La, Nd, Sm, Gd, Dy, and MM (misch metal) were respectively weighed so as to provide alloy compositions of Examples 67-98 of the present invention and Comparative Example 25 as listed in Table 7 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were poured into a copper mold with a cylindrical hole having a diameter of 1 mm to 4 mm by a copper mold casting method so as to produce rod-like samples having various diameters and a length of about 15 mm. Cross-sections of those rod-like samples were evaluated by an X-ray diffraction method so as to determine whether the samples had an amorphous single phase or a crystal phase. Additionally, for rod-like samples having a fully amorphous single phase, the supercooled liquid region ΔTx was calculated from measurement of the glass transition temperature Tg and the crystallization temperature Tx by DSC, and the saturation magnetic flux density Bs was measured by VSM. For alloys that could not form a rod-like sample having an amorphous single phase of at least 1 mm, the saturation magnetic flux density Bs was measured on ribbons having a thickness of 20 μm. Table 7 shows the measurement results of the saturation magnetic flux density Bs, the supercooled liquid region ΔTx, and the maximum diameter $d_{max}$ of the amorphous alloys having compositions according to Examples 67-98 of the present invention and Comparative Example 25.

TABLE 7

| | Alloy Composition (at %) | Bs (T) | ΔTx (° C.) | $d_{max}$ (mm) |
|---|---|---|---|---|
| Example 67 | $Fe_{76}Si_9B_{10}P_5$ | 1.51 | 52 | 2.5 |
| Example 68 | $Fe_{75}Si_9B_{10}P_5Nb_1$ | 1.45 | 52 | 3 |
| Example 69 | $Fe_{75}Si_9B_{10}P_{4.9}Nb_1Cu_{0.1}$ | 1.45 | 53 | 3 |
| Example 70 | $Fe_{75}Si_9B_{10}P_{4.8}Nb_1Cu_{0.2}$ | 1.43 | 51 | 2 |
| Example 71 | $Fe_{74}Si_9B_{10}P_5Nb_2$ | 1.37 | 54 | 2.5 |
| Example 72 | $Fe_{73}Si_9B_{10}P_5Nb_3$ | 1.31 | 42 | 2.5 |
| Comparative Example 25 | $Fe_{73}Si_8B_{10}P_5Nb_4$ | 1.24 | 38 | 2.0 |
| Example 73 | $Fe_{54}Co_{20}Si_9B_{10}P_5Nb_2$ | 1.36 | 51 | 2 |
| Example 74 | $Fe_{75}Si_9B_{10}P_5V_1$ | 1.42 | 49 | 2.0 |
| Example 75 | $Fe_{75}Si_9B_{10}P_5Ti_1$ | 1.43 | 32 | 1.5 |
| Example 76 | $Fe_{75}Si_9B_{10}P_5Mn_1$ | 1.43 | 51 | 2.5 |
| Example 77 | $Fe_{75}Si_9B_{10}P_5Zn_1$ | 1.50 | 49 | 2.5 |
| Example 78 | $Fe_{75}Si_9B_{10}P_5Sn_1$ | 1.48 | 50 | 2 |
| Example 79 | $Fe_{75}Si_9B_{10}P_5Y_1$ | 1.46 | 52 | 2 |
| Example 80 | $Fe_{75}Si_9B_{10}P_5Zr_1$ | 1.47 | 36 | 1.5 |
| Example 81 | $Fe_{75}Si_9B_{10}P_5Hf_1$ | 1.42 | 51 | 2 |
| Example 82 | $Fe_{75}Si_9B_{10}P_5Ta_1$ | 1.40 | 48 | 2 |
| Example 83 | $Fe_{75}Si_9B_{10}P_{4.9}Mo_1Cu_{0.1}$ | 1.43 | 55 | 2.5 |

TABLE 7-continued

| | Alloy Composition (at %) | Bs (T) | ΔTx (° C.) | $d_{max}$ (mm) |
|---|---|---|---|---|
| Example 84 | $Fe_{75}Si_9B_{10}P_5Mo_1$ | 1.43 | 55 | 2.5 |
| Example 85 | $Fe_{75}Si_9B_{10}P_5W_1$ | 1.38 | 36 | 1.5 |
| Example 86 | $Fe_{75.5}Si_9B_{10}P_5La_{0.5}$ | 1.48 | 48 | 2.0 |
| Example 87 | $Fe_{75.5}Si_9B_{10}P_5Nd_{0.5}$ | 1.47 | 35 | 1.5 |
| Example 88 | $Fe_{75.5}Si_9B_{10}P_5Sm_{0.5}$ | 1.46 | 46 | 2.5 |
| Example 89 | $Fe_{75.5}Si_9B_{10}P_{4.9}Cu_{0.1}Sm_{0.5}$ | 1.46 | 44 | 2.5 |
| Example 89 | $Fe_{75.5}Si_9B_{10}P_5Gd_{0.5}$ | 1.42 | 48 | 1 |
| Example 90 | $Fe_{75.5}Si_9B_{10}P_5Dy_{0.5}$ | 1.43 | 55 | 3 |
| Example 91 | $Fe_{75.5}Si_9B_{10}P_{4.9}Dy_{0.5}Cu_{0.1}$ | 1.42 | 54 | 2.5 |
| Example 93 | $Fe_{75.5}Si_9B_{10}P_5MM_{0.5}$ | 1.47 | 49 | 1.5 |
| Example 94 | $Fe_{75.5}Si_9B_{10}P_{4.9}MM_{0.5}Cu_{0.1}$ | 1.46 | 50 | 1.5 |
| Example 95 | $Fe_{74}Si_9B_{10}P_5Nb_1Mo_1$ | 1.36 | 53 | 2.5 |
| Example 96 | $Fe_{74}Si_9B_{10}P_{4.9}Nb_1Mo_1Cu_{0.1}$ | 1.36 | 53 | 2.5 |
| Example 97 | $Fe_{74}Si_9B_8P_5C_2Mo_2$ | 1.34 | 50 | 3 |
| Example 98 | $Fe_{54}Co_{20}Si_9B_8P_5C_2Mo_2$ | 1.34 | 46 | 3 |

As shown in Table 7, each of the amorphous alloy compositions of Examples 67-98 had a saturation magnetic flux density Bs of at least 1.30 T, also had a clear supercooled liquid region ΔTx of at least 30° C., and had an outside diameter of at least 1 mm.

Among the compositions listed in Table 7, the compositions of Examples 67-72 and Comparative Example 25 correspond to cases where the Nb element, which is a metallic element exchangeable with the Fe element, is varied from 0 at % to 4 at %. The cases of Examples 67-72 met conditions of Bs≧1.30 T and $d_{max}$≧1 mm as those alloys had the aforementioned specific composition. Furthermore, those compositions had a clear supercooled liquid region ΔTx. Comparative Example 25 containing the Nb element at 4 at % had a clear supercooled liquid region ΔTx of at least 30° C. and a maximum diameter $d_{max}$ of 1 mm. However, the Nb content was so excessive that the saturation magnetic flux density Bs was lower than 1.30 T.

Among the compositions listed in Table 7, the compositions of Examples 67-98 correspond to cases where the Fe element is replaced with metallic elements such as V, Ti, Mn, Sn, Zn, Y, Zr, Hf, Nb, Ta, Mo, and W, and rare-earth elements. The cases of Examples 67-98 met conditions of Bs≧1.30 T and $d_{max}$≧1 mm as those alloys had the aforementioned specific composition. Furthermore, those compositions had a clear supercooled liquid region ΔTx.

Amorphous alloy compositions in which Cu was added to each of the above examples were evaluated in detail. As a result, each amorphous alloy composition had a saturation magnetic flux density Bs of at least 1.30 T and a clear supercooled liquid region ΔTx of at least 30° C. as with Examples 69, 70, 83, 89, 92, 94, and 96, and also had a maximum diameter $d_{max}$ of at least 1 mm.

Examples 99-106 and Comparative Examples 26-29

As continuous ribbons having a larger width are industrially valuable, samples having a large width were produced. Generally, when the width of a ribbon is larger, a liquid quenching rate is lowered so that the maximum thickness $t_{max}$ is reduced. Materials of Fe, Si, B, $Fe_{75}P_{25}$, Cu, $Fe_{80}C_{20}$, and Nb were respectively weighed so as to provide alloy compositions of Examples 99-106 of the present invention and Comparative Examples 26-29 as listed in Table 8 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed by a single-roll liquid quenching method so as to produce continuous ribbons having various thicknesses, a width of about 5 mm to about 10 mm, and a length of 5 m. The maximum thickness $t_{max}$ was measured for each ribbon by evaluation with an X-ray diffraction method on a surface of the ribbon that did not contact with copper rolls at the time of quenching at which a cooling rate of the ribbon becomes the lowest. Furthermore, for ribbons having a fully amorphous single phase, the saturation magnetic flux density Bs was measured by VSM. Table 8 shows the measurement results of the saturation magnetic flux density Bs, the maximum thickness $t_{max}$, and the ribbon width of the amorphous alloys having compositions according to Examples 99-106 of the present invention and Comparative Examples 26-29.

TABLE 8

| | Alloy Composition (at %) | Bs (T) | $t_{max}$ (μm) | Ribbon Width (mm) |
|---|---|---|---|---|
| Example 99 | $Fe_{76}Si_9B_{10}P_5$ | 1.51 | 210 | 5.3 |
| Example 100 | $Fe_{76}Si_9B_{10}P_5$ | 1.51 | 150 | 11.0 |
| Example 101 | $Fe_{76}Si_9B_8P_5C_2$ | 1.51 | 200 | 5.0 |
| Example 102 | $Fe_{76}Si_9B_8P_5C_2$ | 1.50 | 140 | 9.4 |
| Example 103 | $Fe_{77.9}Si_8B_{10}P_4Cu_{0.1}$ | 1.57 | 160 | 5.5 |
| Example 104 | $Fe_{77.9}Si_8B_{10}P_4Cu_{0.1}$ | 1.56 | 115 | 10.1 |
| Example 105 | $Fe_{80.9}Si_6B_{11}P_2Cu_{0.1}$ | 1.62 | 55 | 4.8 |
| Example 106 | $Fe_{80.9}Si_6B_{11}P_2Cu_{0.1}$ | 1.61 | 30 | 9.8 |
| Comparative Example 26 | $Fe_{78}Si_9B_{13}$ | 1.56 | 28 | 5.1 |
| Comparative Example 27 | $Fe_{78}Si_9B_{13}$ | 1.55 | 22 | 10.9 |
| Comparative Example 28 | $(Fe_{0.75}Si_{0.10}B_{0.15})_{96}Nb_4$ | 1.16 | 200 | 6.0 |
| Comparative Example 29 | $(Fe_{0.75}Si_{0.10}B_{0.15})_{96}Nb_4$ | 1.17 | 120 | 12.2 |

As shown in Table 8, each of the amorphous alloy compositions of Examples 99-106 had a saturation magnetic flux density Bs of at least 1.30 T, had a higher capability of forming an amorphous phase as compared to Comparative Examples 26 and 27, which are conventional amorphous compositions formed of the Fe, Si, and B elements, and had a maximum thickness $t_{max}$ of at least 30 μm.

Among the compositions listed in Table 8, the compositions of Examples 99, 101, 103, and 105 and Comparative Examples 26 and 28 were ribbons having a width of about 5 mm. The compositions of Examples 100, 102, 104, and 106 and Comparative Example 27 and 29 were ribbons having a width of about 10 mm. The cases of Examples 99-106 met conditions of Bs≧1.30 T and $t_{max}$≧30 μm as those alloys had the aforementioned composition. In contrast thereto, the cases of Comparative Examples 26 and 27 had a high saturation magnetic flux density Bs, but its maximum thickness $t_{max}$ was smaller than 30 μm. The cases of Comparative Examples 28 and 29 had a large maximum thickness $t_{max}$, but its saturation magnetic flux density Bs was lower than 1.30 T.

Examples 107 and 108 and Comparative Examples 30-32

Materials of Fe, Si, B, $Fe_{75}P_{25}$, Cu, $Fe_{80}C_{20}$, Nb, Al, and Ga were respectively weighed so as to provide alloy compositions of Examples 107 and 108 of the present invention and Comparative Examples 30-32 as listed in Table 9 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed with a twin-roll quenching apparatus, which is usually used to produce a thick plate, so as to produce plate-like samples having a width of 5 mm and a thickness of 0.5 mm. Cross-sections of those plate-like samples were evaluated by an X-ray diffraction method so as to determine whether the samples had an amorphous single phase or a crystal phase. Furthermore, for plate-like samples having a fully amorphous single phase, the saturation magnetic flux density Bs was measured by VSM. For alloys that could not form a plate-like sample having an amorphous single phase, the saturation magnetic flux density Bs was measured on ribbons having a thickness of 20 μm. Table 9 shows the measurement results of the saturation magnetic flux density Bs of the amorphous alloys having compositions according to Examples 107 and 108 of the present invention and Comparative Examples 30-32, and the X-ray diffraction of cross-section of the plate-like sample for those amorphous alloys.

TABLE 9

| | Alloy Composition (at %) | Bs (T) | X-ray Diffraction Results of Cross-section of Plate Member |
|---|---|---|---|
| Example 107 | $Fe_{76}Si_9B_{10}P_5$ | 1.51 | Amorphous Phase |
| Example 108 | $Fe_{76}Si_9B_8P_5C_2$ | 1.50 | Amorphous Phase |
| Comparative Example 30 | $Fe_{78}Si_9B_{13}$ | 1.56 | Crystal Phase |
| Comparative Example 31 | $(Fe_{0.75}Si_{0.10}B_{0.15})_{96}Nb_4$ | 1.18 | Amorphous Phase |
| Comparative Example 32 | $Fe_{72}Al_5Ga_2P_{10}C_6B_4Si_1$ | 1.14 | Amorphous Phase |

As shown in Table 9, each of the amorphous alloy compositions of Examples 107 and 108 had a saturation magnetic flux density Bs of at least 1.30 T and also had a thickness of at least 0.5 mm. In contrast thereto, Comparative Example 30 had a high saturation magnetic flux density Bs but a low capability of forming an amorphous phase, so that a plate-like sample of an amorphous single phase having a thickness of 0.5 mm could not be produced. Furthermore, Comparative Examples 31 and 32, which are typical metallic glass alloys that have been well known, had a supercooled liquid region ΔTx and could form a plate-like sample of an amorphous single phase having a thickness of 0.5 mm. However, the Fe content was low, and the saturation magnetic flux density Bs was lower than 1.30.

Examples 109 and 110 and Comparative Examples 33-35

Figure 7:
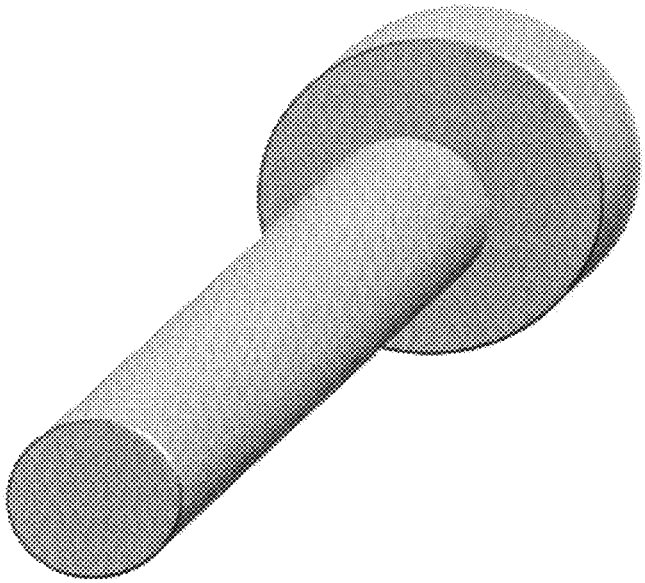
FIG. 7 is a perspective view showing an appearance of an example of a magnetic member.
Figure 8:
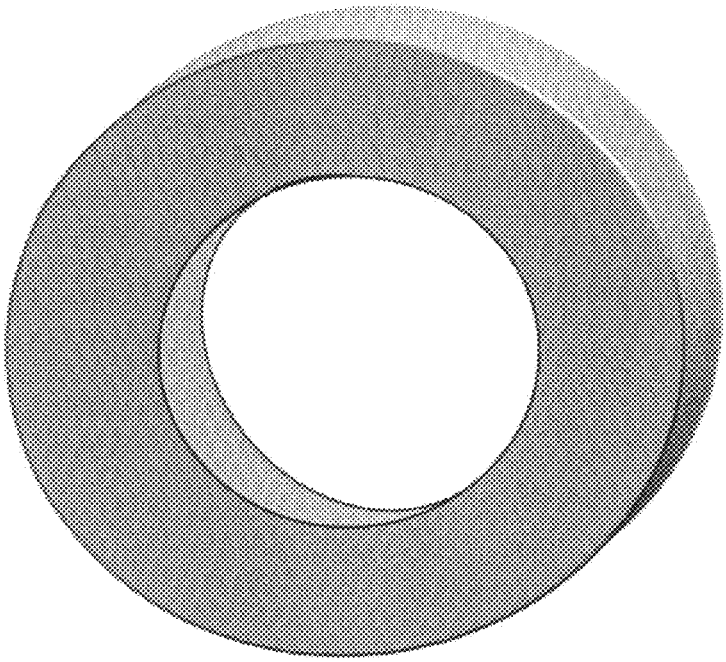
FIG. 8 is a perspective view showing an appearance of an example of a magnetic member.

Materials of Fe, Si, B, $Fe_{75}P_{25}$, Cu, $Fe_{80}C_{20}$, Nb, Al, and Ga were respectively weighed so as to provide alloy compositions of Examples 109 and 110 of the present invention and Comparative Examples 33-35 as listed in Table 10 below and put into an alumina crucible. The crucible was placed within a vacuum chamber of a high-frequency induction heating apparatus, which was evacuated. Then, the materials were melted within a reduced-pressure Ar atmosphere by high-frequency induction heating to produce master alloys. The master alloys were processed by a copper mold casting method so as to produce samples as shown in FIG. 7, which included a plate having an outside diameter of 2 mm and a rod disposed perpendicular to the plate at the center of the plate with an outside diameter of 1 mm and a length of 5 mm, and ring-shaped samples as shown in FIG. 8, which had an outside diameter of 10 mm, an inside diameter of 6 mm, and a thickness of 1 mm. Those samples were ground into powder with an agate mortar, and the powder was evaluated by an X-ray diffraction method so as to determine whether the samples had an amorphous single phase or a crystal phase. For samples of a fully amorphous single phase having a shape shown in FIG. 8, the saturation magnetic flux density Bs was measured by VSM. For alloys that could not form a sample having an amorphous single phase, the saturation magnetic flux density Bs was measured on ribbons having a thickness of 20 μm. Table 10 shows the measurement results of the saturation magnetic flux density Bs of the amorphous alloys having compositions according to Examples 109 and 110 of the present invention and Comparative Examples 33-35, and the X-ray diffraction of the samples having shapes shown in FIGS. 7 and 8 for those amorphous alloys.

TABLE 10

| | Alloy Composition (at %) | Bs (T) | X-ray Diffraction Results of Shape in FIG. 7 | X-ray Diffraction Results of Shape in FIG. 8 |
|---|---|---|---|---|
| Example 109 | $Fe_{76}Si_9B_{10}P_5$ | 1.51 | Amorphous Phase | Amorphous Phase |
| Example 110 | $Fe_{76}Si_9B_8P_5C_2$ | 1.49 | Amorphous Phase | Amorphous Phase |
| Comparative Example 33 | $Fe_{78}Si_9B_{13}$ | 1.56 | Crystal Phase | Crystal Phase |
| Comparative Example 34 | $(Fe_{0.75}Si_{0.10}B_{0.15})_{96}Nb_4$ | 1.18 | Crystal Phase | Amorphous Phase |
| Comparative Example 35 | $Fe_{72}Al_5Ga_2P_{10}C_6B_4Si_1$ | 1.13 | Amorphous Phase | Amorphous Phase |

As shown in Table 10, each of the amorphous alloy compositions of Examples 109 and 110 had a saturation magnetic flux density Bs of at least 1.30 T and could produce samples of an amorphous single phase with regard to both of shapes shown in FIGS. 7 and 8. In contrast thereto, Comparative Example 33 had a high saturation magnetic flux density Bs but a low capability of forming an amorphous phase, so that the X-ray diffraction results demonstrated that a crystal phase was formed for both of the shapes shown in FIGS. 7 and 8. Furthermore, Comparative Examples 34 and 35 had a saturation magnetic flux density Bs lower than 1.30. Moreover, the X-ray diffraction results of the shape shown in FIG. 7 demonstrated that Comparative Example 34 had a crystal phase.

The invention claimed is:

1. An amorphous alloy composition of the formula $Fe_aB_bSi_cP_xCu_y$, wherein 73 at %≦a≦85 at %, 9.65 at %≦b≦22 at %, 9.65 at %≦b+c≦24.75 at %, 0.25 at %≦x≦5 at %, 0 at %<y≦0.35 at %, and 0<y/x≦0.5.

2. The amorphous alloy composition as recited in claim 1, further comprising 2 at % or less of C, wherein b is the total amount of B and C.

3. The amorphous alloy composition as recited in claim 2, further comprising 30 at % or less of at least one element selected from the group consisting of Co and Ni, wherein a is the total amount of Fe and the at least one element.

4. The amorphous alloy composition as recited in claim 3, further comprising 3 at % or less of at least one element selected from the group consisting of V, Ti, Mn, Sn, Zn, Y, Zr, Hf, Nb, Ta, Mo and a rare-earth element, wherein a is the total amount of Fe and the at least one elements.

5. The amorphous alloy composition as recited in claim 4, wherein the amorphous alloy composition has a ribbon shape having a thickness in a range of from 30 μm to 300 μm.

6. The amorphous alloy composition as recited in claim 3, wherein the amorphous alloy composition has a ribbon shape having a thickness in a range of from 30 μm to 300 μm.

7. The amorphous alloy composition as recited in claim 2, further comprising 3 at % or less of at least one element selected from the group consisting of V, Ti, Mn, Sn, Zn, Y, Zr, Hf, Nb, Ta, Mo and a rare-earth element, wherein a is the total amount of Fe and the at least one element.

8. The amorphous alloy composition as recited in claim 7, wherein the amorphous alloy composition has a ribbon shape having a thickness in a range of from 30 μm to 300 μm.

9. The amorphous alloy composition as recited in claim 2, wherein the amorphous alloy composition has a ribbon shape having a thickness in a range of from 30 μm to 300 μm.

10. The amorphous alloy composition as recited in claim 1, further comprising 30 at % or less of at least one element selected from the group consisting of Co and Ni, wherein a is the total amount of Fe and the at least one element.

11. The amorphous alloy composition as recited in claim 10, further comprising 3 at % or less of at least one element selected from the group consisting of V, Ti, Mn, Sn, Zn, Y, Zr, Hf, Nb, Ta, Mo and a rare-earth element, wherein a is the total amount of Fe and the at least one elements.

12. The amorphous alloy composition as recited in claim 11, wherein the amorphous alloy composition has a ribbon shape having a thickness in a range of from 30 μm to 300 μm.

13. The amorphous alloy composition as recited in claim 10, wherein the amorphous alloy composition has a ribbon shape having a thickness in a range of from 30 μm to 300 μm.

14. The amorphous alloy composition as recited in claim 1, further comprising 3 at % or less of at least one element selected from the group consisting of V, Ti, Mn, Sn, Zn, Y, Zr, Hf, Nb, Ta, Mo and a rare-earth element, wherein a is the total amount of Fe and the at least one element.

15. The amorphous alloy composition as recited in claim 14, wherein the amorphous alloy composition has a ribbon shape having a thickness in a range of from 30 μm to 300 μm.

16. The amorphous alloy composition as recited in claim 1, wherein the amorphous alloy composition has a ribbon shape having a thickness in a range of from 30 μm to 300 μm.

17. The amorphous alloy composition as recited in claim 1, wherein the amorphous alloy composition has a plate-like shape having a thickness of at least 0.5 mm or a rod-like shape having an outside diameter of at least 1 mm.

18. The amorphous alloy composition as recited in claim 1, wherein the amorphous alloy composition has a shape including a plate-like portion or a rod-like portion having a thickness of at least 1 mm.

19. The amorphous alloy composition as recited in claim 1, wherein 0.01 at %$\leqq y \leqq$0.35 at %.

* * * * *